US005862953A

United States Patent [19]

Long, Jr.

[11] Patent Number: 5,862,953

[45] Date of Patent: Jan. 26, 1999

[54] TAMPER EVIDENT PUSH-PULL CLOSURE WITH POUR SPOUT

[75] Inventor: Charles J. Long, Jr., New Castle, Pa.

[73] Assignee: International Plastics and Equipment Corporation, New Castle, Pa.

[21] Appl. No.: 687,149

[22] Filed: Jul. 24, 1996

Related U.S. Application Data

[63] Continuation-in-part of Ser. No. 633,225, Apr. 16, 1996.

[51] Int. Cl.[6] ..... B67D 5/00

[52] U.S. Cl. ..... 222/153.06; 222/525; 222/541.6

[58] Field of Search ..... 222/153.06, 521, 222/522, 523, 524, 525, 541.6

[56] References Cited

U.S. PATENT DOCUMENTS

| | | | |
|---|---|---|---|
| 1,443,682 | 1/1923 | Guerity . | |
| 1,630,687 | 5/1927 | Aulbach . | |
| 1,866,770 | 7/1932 | Hilgenberg . | |
| 2,181,340 | 11/1939 | Plumb | 220/39 |
| 2,684,168 | 7/1954 | McGinnis | 215/43 |
| 2,789,717 | 4/1957 | Demke | 215/320 X |
| 2,805,001 | 9/1957 | Biederman | 222/211 |
| 2,998,902 | 9/1961 | Thomas et al. | 222/499 |
| 3,022,917 | 2/1962 | Montgomery | 215/44 |
| 3,073,472 | 1/1963 | Williams | 215/46 |
| 3,120,900 | 2/1964 | Faulstich | 215/46 |
| 3,223,269 | 12/1965 | Williams | 215/43 |
| 3,372,833 | 3/1968 | Baranne | 220/39 |
| 3,392,860 | 7/1968 | Faulstich | 215/254 |
| 3,407,957 | 10/1968 | Robinson | 215/42 |
| 3,434,613 | 3/1969 | Langecker | 215/41 |
| 3,504,818 | 4/1970 | Crisci | 215/42 |
| 3,677,430 | 7/1972 | Yates, Jr. | 215/41 |
| 3,682,345 | 8/1972 | Baugh | 215/43 R |
| 3,688,942 | 9/1972 | Mitchell | 220/60 R |
| 3,695,475 | 10/1972 | Ruekberg | 215/9 |
| 3,792,793 | 2/1974 | Rose | 215/221 |
| 3,812,994 | 5/1974 | Feldman | 215/256 |

(List continued on next page.)

FOREIGN PATENT DOCUMENTS

| | | |
|---|---|---|
| 480881 | 9/1975 | Australia . |
| 812597 | 5/1969 | Canada . |
| 009525 | 4/1980 | European Pat. Off. . |
| 0118267 | 9/1984 | European Pat. Off. . |
| 298247 | 5/1988 | European Pat. Off. . |
| 337046 | 10/1989 | European Pat. Off. . |
| 450959 | 10/1991 | European Pat. Off. . |
| 683106 | 11/1995 | European Pat. Off. . |
| 688724 | 12/1995 | European Pat. Off. . |
| 2538787 | 7/1984 | France . |
| 2682357 | 4/1993 | France . |
| 1154369 | 9/1963 | Germany . |
| 2356007 | 2/1973 | Germany . |
| 2852080 | 8/1979 | Germany . |
| 372235 | 1/1989 | Germany . |
| 9005575.6 | 7/1990 | Germany . |
| 4321649 | 1/1995 | Germany . |
| 7312410 | 11/1975 | Netherlands . |
| 510563 | 9/1971 | Switzerland . |
| 2068912 | 8/1981 | United Kingdom . |
| 2102774 | 2/1983 | United Kingdom . |
| 2105693 | 3/1983 | United Kingdom . |

(List continued on next page.)

*Primary Examiner*—Joseph A. Kaufman
*Attorney, Agent, or Firm*—Titus & McConomy LLP

[57] ABSTRACT

A resealable push-pull pour spout closure having an annular secondary closure with a central opening through which a plug is adapted to engage to close a container. The central opening is defined by an annular wall having at least one internally extending annular flange. The diameter of the central opening is substantially the same as that of the plug. The plug takes the form of a circular closure disk having an integrally molded depending annular skirt projecting from the periphery of the disk that attaches to angularly extending legs that connect the plug to the spout thereby defining a hollow cavity for the plug interior and increasing the structural flexibility of the plug. The annular seal flange projects radially into opening for form fitting engagement with the plug to substantially eliminate any leakage when the plug is positioned in the central opening.

13 Claims, 5 Drawing Sheets

U.S. PATENT DOCUMENTS

| | | | |
|---|---|---|---|
| 3,837,518 | 9/1974 | Gach | 215/7 |
| 3,844,443 | 10/1974 | Cudzik | 220/40 R |
| 3,868,039 | 2/1975 | Holbrook | 215/309 |
| 3,874,540 | 4/1975 | Hidding | 215/252 |
| 3,893,583 | 7/1975 | McLaren | 215/256 |
| 3,901,404 | 8/1975 | Feldman | 215/256 |
| 3,902,621 | 9/1975 | Hidding | 215/252 |
| 3,913,772 | 10/1975 | Ochs | 215/256 |
| 3,928,109 | 12/1975 | Pollock et al. | 156/272 |
| 3,940,004 | 2/1976 | Faulstich | 215/256 |
| 3,942,679 | 3/1976 | Starr | 220/355 |
| 3,963,139 | 6/1976 | Gach | 215/216 |
| 3,973,719 | 8/1976 | Johnson et al. | 229/5.6 |
| 3,980,195 | 9/1976 | Fillmore | 215/256 |
| 4,034,882 | 7/1977 | Wright | 215/217 |
| 4,037,746 | 7/1977 | Ver Hage | 215/31 |
| 4,053,077 | 10/1977 | DeFelice | 215/217 |
| 4,066,182 | 1/1978 | Allen et al. | 215/256 |
| 4,078,700 | 3/1978 | Hidding | 222/109 |
| 4,084,716 | 4/1978 | Bogert | 215/217 |
| 4,098,419 | 7/1978 | Virog, Jr. et al. | 215/252 |
| 4,166,552 | 9/1979 | Faulstich | 215/256 |
| 4,177,906 | 12/1979 | Hagel | 215/252 |
| 4,180,175 | 12/1979 | Virog et al. | 215/252 |
| 4,202,455 | 5/1980 | Faulstich | 215/31 |
| 4,230,229 | 10/1980 | Crisci | 215/253 |
| 4,241,841 | 12/1980 | Boller | 215/252 |
| 4,269,320 | 5/1981 | Virog, Jr. et al. | 215/252 |
| 4,298,129 | 11/1981 | Stull | 215/221 |
| 4,301,937 | 11/1981 | Von Hagel | 215/252 |
| 4,305,517 | 12/1981 | Dennis | 215/256 |
| 4,307,821 | 12/1981 | McIntosh | 222/83 |
| 4,330,067 | 5/1982 | Deussen | 215/220 |
| 4,354,609 | 10/1982 | Hidding | 215/252 |
| 4,385,708 | 5/1983 | Curry | 215/256 |
| 4,401,227 | 8/1983 | Pehr | 215/252 |
| 4,402,415 | 9/1983 | Hopley | 215/32 |
| 4,437,593 | 3/1984 | Bullock, III | 222/541 |
| 4,438,857 | 3/1984 | Bullock, III | 215/256 |
| 4,448,319 | 5/1984 | Kern | 215/329 |
| 4,469,253 | 9/1984 | Beard | 222/153 |
| 4,484,687 | 11/1984 | Bullock, III | 215/256 |
| 4,496,066 | 1/1985 | Bullock, III | 215/320 |
| 4,497,765 | 2/1985 | Wilde | 264/268 |
| 4,498,597 | 2/1985 | Bashour | 215/329 |
| 4,500,016 | 2/1985 | Funfstuck | 222/153 |
| 4,506,797 | 3/1985 | Bullock, III | 215/256 |
| 4,519,569 | 5/1985 | Nolan | 249/142 |
| 4,530,437 | 7/1985 | Gray | 215/252 |
| 4,534,480 | 8/1985 | Santostasi | 215/252 |
| 4,540,098 | 9/1985 | Luker | 215/216 |
| 4,540,102 | 9/1985 | Wiedmer | 215/344 |
| 4,548,239 | 10/1985 | Curry | 215/216 |
| 4,561,553 | 12/1985 | Crisci | 215/256 |
| 4,567,991 | 2/1986 | Anderson | 215/216 |
| 4,572,387 | 2/1986 | Luker et al. | 215/252 |
| 4,589,561 | 5/1986 | Crisci | 215/256 |
| 4,593,830 | 6/1986 | Bullock | 215/256 |
| 4,625,875 | 12/1986 | Carr et al. | 215/232 |
| 4,632,265 | 12/1986 | Cochrane | 215/232 |
| 4,658,977 | 4/1987 | Crsci | 215/256 |
| 4,664,278 | 5/1987 | Barriac | 215/252 |
| 4,667,839 | 5/1987 | Crisci | 215/256 |
| 4,676,389 | 6/1987 | Bullock | 215/232 |
| 4,687,114 | 8/1987 | Crisci | 215/256 |
| 4,699,286 | 10/1987 | Nolan | 215/256 |
| 4,699,287 | 10/1987 | Bullock | 215/256 |
| 4,700,860 | 10/1987 | Li | 215/256 |
| 4,709,823 | 12/1987 | Beck et al. | 215/232 |
| 4,729,488 | 3/1988 | Bullock, III | 215/256 |
| 4,739,891 | 4/1988 | Bullock, III | 215/232 |
| 4,744,478 | 5/1988 | Hahn | 215/252 |
| 4,749,103 | 6/1988 | Barriac | 222/48 |
| 4,751,036 | 6/1988 | Barriac | 264/318 |
| 4,770,306 | 9/1988 | Szczesniak | 215/252 |
| 4,779,764 | 10/1988 | Debetencourt | 222/83 |
| 4,785,952 | 11/1988 | Obadia | 215/329 |
| 4,796,770 | 1/1989 | Begley | 215/252 |
| 4,801,030 | 1/1989 | Barriac | 215/252 |
| 4,801,032 | 1/1989 | Crisci | 215/256 |
| 4,805,807 | 2/1989 | Perne | 222/153 |
| 4,807,770 | 2/1989 | Barriac | 215/252 |
| 4,815,617 | 3/1989 | Cullum | 215/232 |
| 4,815,620 | 3/1989 | Bullock, III | 215/256 |
| 4,826,055 | 5/1989 | Stull | 222/524 |
| 4,828,128 | 5/1989 | Tackles | 215/256 |
| 4,834,252 | 5/1989 | Crisci | 215/256 |
| 4,836,407 | 6/1989 | Bruce et al. | 220/276 |
| 4,844,250 | 7/1989 | Holoubek et al. | 222/107 |
| 4,844,268 | 7/1989 | Bullock, III | 215/256 |
| 4,852,774 | 8/1989 | Crawford | 222/545 |
| 4,903,849 | 2/1990 | Wallman | 215/256 |
| 4,927,065 | 5/1990 | Beck | 222/520 |
| 4,930,647 | 6/1990 | Dutt et al. | 215/252 |
| 4,934,546 | 6/1990 | Markley | 215/256 |
| 4,938,370 | 7/1990 | McBride | 215/252 |
| 4,946,055 | 8/1990 | Towns et al. | 215/254 |
| 4,948,001 | 8/1990 | Magly | 215/31 |
| 4,948,003 | 8/1990 | Munoz | 215/237 |
| 4,981,230 | 1/1991 | Marshell et al. | 215/252 |
| 4,989,740 | 2/1991 | Vercillo | 215/252 |
| 5,004,114 | 4/1991 | Terbrusch | 220/296 |
| 5,009,323 | 4/1991 | Montgomery | 215/252 |
| 5,036,991 | 8/1991 | Wallman | 215/256 |
| 5,103,991 | 4/1992 | Collins | 215/329 |
| 5,104,008 | 4/1992 | Crisci | 222/183 |
| 5,105,960 | 4/1992 | Crisci et al. | 215/329 |
| 5,129,530 | 7/1992 | Fuchs | 215/252 |
| 5,186,369 | 2/1993 | Aguirrezabal | 222/521 |
| 5,199,635 | 4/1993 | Abrams et al. | 229/125.09 |
| 5,213,224 | 5/1993 | Luch | 215/256 |
| 5,224,616 | 7/1993 | Crisci | 215/256 |
| 5,267,661 | 12/1993 | Luch et al. | 215/256 |
| 5,285,912 | 2/1994 | Molinaro | 215/256 |
| 5,285,933 | 2/1994 | Gentes et al. | 222/148 |
| 5,303,838 | 4/1994 | Luch | 222/541 X |
| 5,307,945 | 5/1994 | Hidding et al. | 215/329 |
| 5,307,946 | 5/1994 | Molinaro | 215/329 |
| 5,348,183 | 9/1994 | Luch et al. | 220/256 |
| 5,368,178 | 11/1994 | Towns | 215/317 |
| 5,429,282 | 7/1995 | Stebick | 222/54 |
| 5,437,140 | 8/1995 | Molinaro | 53/331.5 |
| 5,456,376 | 10/1995 | Luch et al. | 215/256 |
| 5,465,876 | 11/1995 | Crisci | 222/153.1 |
| 5,480,045 | 1/1996 | Molinaro et al. | 215/256 |
| 5,553,727 | 9/1996 | Molinaro | 215/44 |
| 5,560,504 | 10/1996 | Molinaro | 215/256 |
| 5,588,562 | 12/1996 | Sander et al. | 222/525 |
| 5,655,685 | 8/1997 | Carr et al. | 222/153.06 |

FOREIGN PATENT DOCUMENTS

| | | |
|---|---|---|
| 2114553 | 8/1983 | United Kingdom . |
| 2163413 | 2/1986 | United Kingdom . |
| 2172273 | 9/1986 | United Kingdom . |
| 2177384 | 1/1987 | United Kingdom . |
| 2191178 | 12/1987 | United Kingdom . |
| 2216505 | 10/1989 | United Kingdom . |
| 2264110 | 8/1993 | United Kingdom . |
| 2269163 | 2/1994 | United Kingdom . |
| US97/02446 | 8/1997 | WIPO . |

TAMPER EVIDENT PUSH-PULL CLOSURE WITH POUR SPOUT

CROSS-REFERENCE

This application is a continuation-in-part of U.S. patent application Ser. No. 08/633,225, filed on Apr. 16, 1996.

FIELD OF THE INVENTION

This device relates to tamper evident closures having a push-pull resealable tamper evident pour spout.

BACKGROUND OF THE INVENTION

Prior art closures having a pour spout or the like are disclosed in U.S. patent application Ser. Nos. 08/332,140 (filed Oct. 31, 1994), 08/633,225 and U.S. Pat. Nos. 5,104,008 and 5,465,876.

Some of these prior spout closures provide tamper evidency and have tamper evident pour spouts but which are not always leak proof at spout closure interface. Generally, prior art push-pull spouts that are reusable do not provide effective sealing at the juncture between the spout opening and the plug positioned in the opening when the spout is closed. Because of the very small diameter of the opening and the concern for safety, it is not possible to add non-integrated sealing means. The present invention solves this problem by utilizing a closure plug which combines a circular closure disk with an integral annular skirt depending from the periphery of the disk thereby defining a hollow cavity for the plug interior and increasing the structural flexibility of the plug. The increased structural flexibility provided by the hollow cavity causes inward deformation of the plug skirt upon engagement with annular flanges integrated into the periphery of the spout closure central opening to create a form-fitting leak tight seal.

Additionally, the present invention provides an improved means of locking the closure to a bottle neck. Projections extending radially inward from the inner surface of the tamper evident band form an upwardly angled "hook" shape for engaging the sealing flange on the bottle neck. This "hooking" engagement prevents removal of the closure while the tamper evident band remains intact.

Finally, a plurality of circumferentially spaced dimples optionally extend from the exterior wall of the pour spout. These dimples engage vertically spaced inturned annular flanges on the interior surface of the spout closure to faciliate breaking the frangible elements connecting the tamper evident band to the spout closure.

Accordingly, it is an object of the present invention to provide an effective seal for a push-pull spout for reusable containers.

It is a further object of the invention to provide a substantially leak proof tamper-evident closure having a reusable, push-pull spout.

It is a further object of the present invention to provide a reusable, push-pull pour spout closure that utilizes a closure plug having increased structural flexibility to provide a more effective leak tight seal.

It is a further object of the present invention to provide a reusable, push-pull pour spout closure that utilizes an upwardly angled locking means to prevent removal of the closure from a bottle neck with the tamper evident band intact.

It is a further object of the present invention to provide a means for faciliating the breakage of frangible elements connecting the tamper evident band to the spout closure.

SUMMARY OF THE INVENTION

The present invention provides a tamper evident plastic closure with a tamper evident push-pull pour spout which is substantially leak proof. Generally, the present invention includes a push pull resealable pour spout with an opening therein which is partially closed by a second top having a secondary opening therein and a plug space thereabove with upwardly angled legs formed integrally with the closure. The plug takes the form of a circular closure disk having an integral annular skirt depending from the periphery of the disk that attaches the plug to the angular legs thereby defining a hollow cavity for the plug interior and increasing the structural flexibility of the plug. Integrated into the periphery of the secondary opening is at least one and preferably two annular flanges which engage the plug skirt when the secondary opening is closed to seal the spout. The annular flanges cause inward deformation of the plug skirt upon engagement to create a form-fitting leak proof seal.

The entire closure is preferably locked to a bottle neck by a series of projections that extend radially inward from the inner surface of a tamper evident band attached to the bottom edge of the closure body. The projections have a flanged edge preferably lying at an angle with a plane normal to the inner surface of the tamper evident band, thereby defining a grooved "hook" which slides over the locking flange on the bottle neck when the closure is placed on the container but which engages and locks the closure to the container neck when removal of the closure is attempted with the tamper evident band intact.

A plurality of circumferentially spaced dimples optionally extend from the exterior wall of the pour spout. These dimples engage vertically spaced inturned annular flanges on the interior surface of the spout closure to faciliate breaking the frangible elements connecting the tamper evident band to the spout closure. Other advantages of the present invention will become apparent from a perusal of the following detailed description of a presently preferred embodiment taken in connection with the accompanying drawings.

DESCRIPTION OF THE PREFERRED EMBODIMENT

Figure 1:
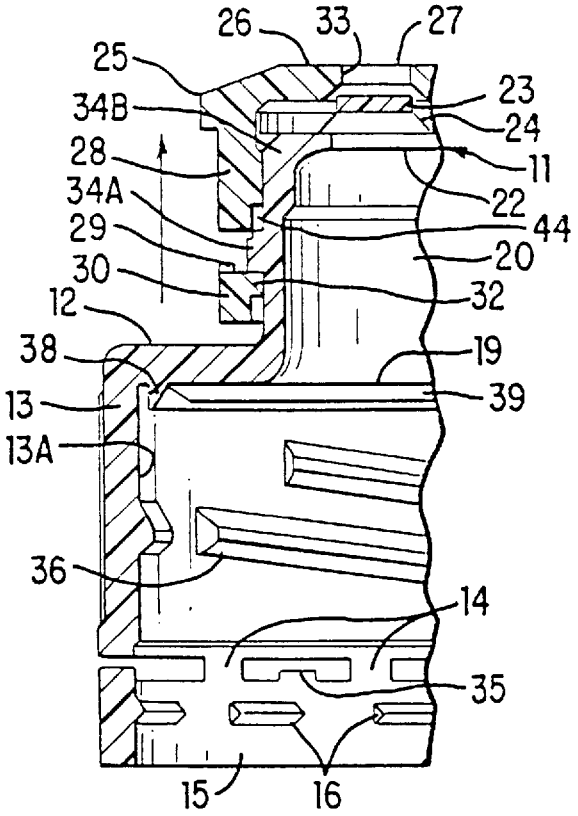
FIG. 1 is a vertical cross-section through a portion of the resealable closure with the push pull pour spout in an opened position.
Figure 2:
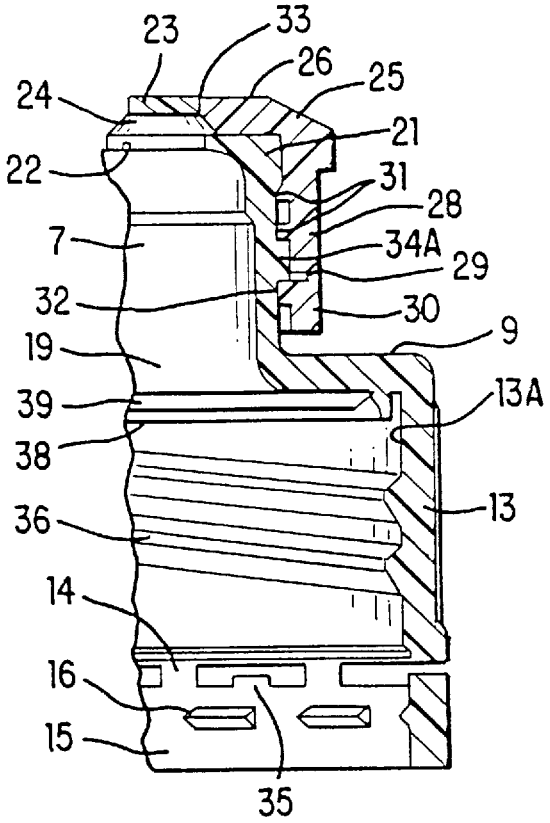
FIG. 2 is a vertical cross-section through a portion of the resealable closure with the push pull top in a closed position.
Figure 3:
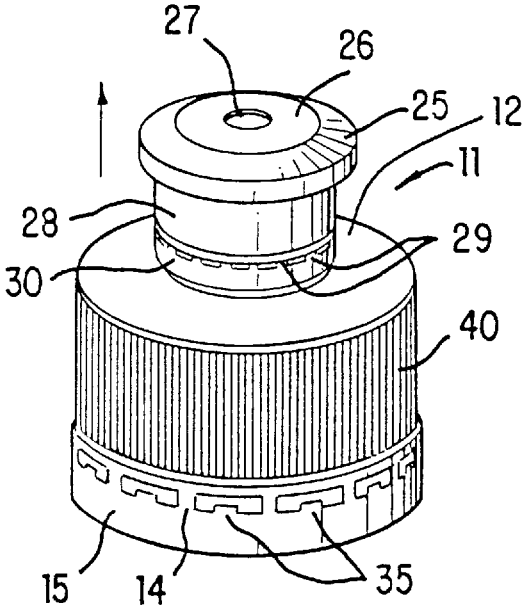
FIG. 3 is a perspective view of the resealable closure.
Figure 4:
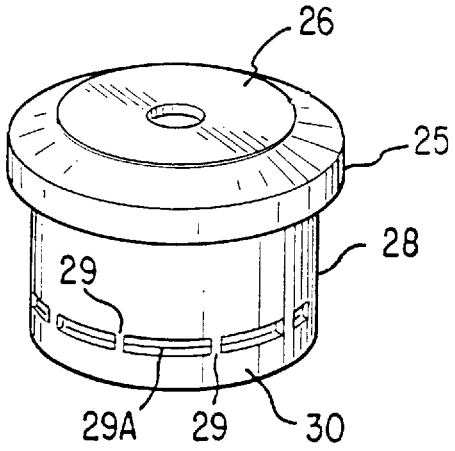
FIG. 4 is a perspective view of a portion of the resealable closure.

Referring to FIGS. 1, 2 and 3 of the drawings, a resealable closure 10 preferably made of high density polyethylene includes a push-pull secondary closure 11, which also is made of high density polyethylene except the spout which is preferably low density polypropylene, positioned thereon. Closure 10 comprises a top portion 12 with an integral depending annular flange 13 extending therefrom. A plurality of circumferentially spaced frangible elements 14 extend from the lower edge of depending flange 13 to a tamper evident ring 15 integrally molded with the closure. Tamper ring 15 is preferably of the same diameter as that of the annular flange 13 and includes a plurality of circumferentially spaced inwardly facing projections 16 thereon.

Figure 7:
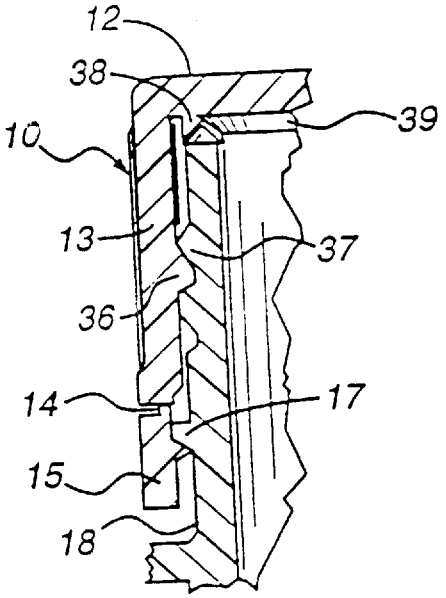
FIG. 7 is a partial enlarged cross-sectional view of a portion of the resealable closure showing the bottle neck configuration.
Figure 8:
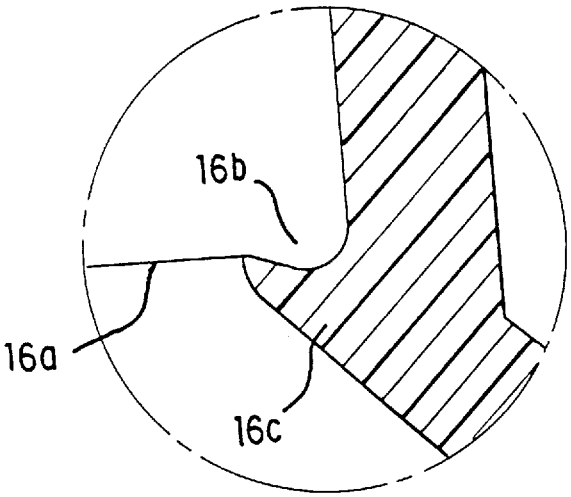
FIG. 8 is an exploded view of the locking means of the present invention.

Referring to FIGS. 1 and 7 of the drawings, projections 16 are circumferentially spaced about the inner surface of said tamper evident ring 15 and are positioned so that they are engagable under an annular locking flange 17 to lock the closure 10 on a bottle neck 18 as seen in FIG. 7 of the drawings. As can be seen in FIG. 8, projections 16 comprise edges 16*a* defining grooves 16*b* formed on radially upwardly extending annular flanges 16*c*. Flanges 16*c* are preferably discontinuous but can be continuous. Edge 16*a* and groove 16*b* provide a "hook" shape for engaging the annular locking flange 17 which has a radius substantially the same as groove 16*b*. The grip provided by engagement of the hooked projections 16 to annular locking flange 17 prevents removal of the closure 10 from the bottle neck 18 while tamper evident ring 15 is intact. Because groove 16*b* is undercut, a mold core must be used that frees or permits removal of undercut prior to stripping the closures from the mold. Various techniques are known to those skilled in the art including the use of movable core sleeves which free the undercut section of the mold.

Figure 9:
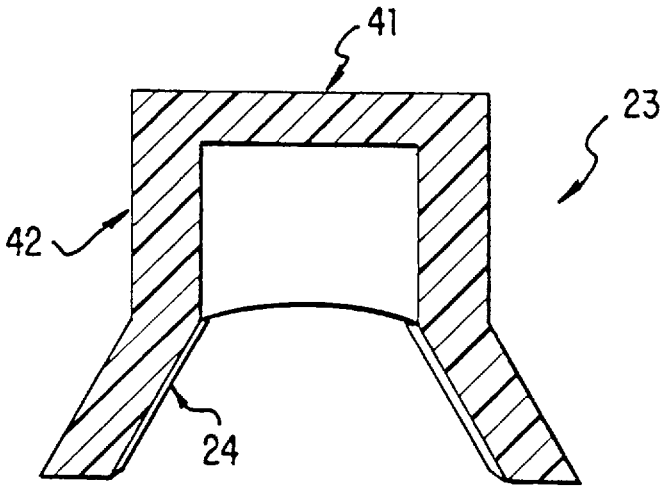
FIG. 9 is an exploded view of the secondary closure plug of the present invention.

Referring to FIG. 1, an opening 19 is preferably formed in the center of the top portion of the cap 12 with an upstanding cylindrical pour spout 20 positioned in registry with opening 19. The upper end of the pour spout 20 includes a secondary top portion 21 thereon which is apertured at 22. A closure plug 23 is positioned on the secondary top portion 21 in spaced relation to aperture 22 by a plurality of circumferentially spaced angularly arranged upwardly extending supports 24. Referring to FIG. 9, the plug 23 is formed by a circular closure disk 41 having an integrally molded annular skirt 42 depending from the periphery of the disk 41. The sidewall of skirt 42 is dimensioned to be thin enough to allow inward deformation of the sidewall upon contact with the central opening surface 27 of spout cap 25 while at the same time being thick enough to ensure that the plug 23 will not break off with repeated use. Skirt 42 attaches plug 23 to the angular supports 24 thereby defining a hollow cavity 43 for the plug interior.

Figure 1A:
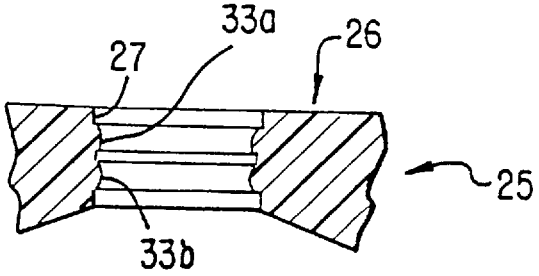
FIG. 1*a* is an enlarged partial section of secondary openings.

A push-pull cap 25 is positioned on the upstanding cylindrical pour spout 20 and has a top surface 26 with a central opening 27 therein which is designed to register with the plug 23 to form a secondary closure when the top cap 25 is in a closed position resting on the secondary top portion 21 of the upstanding cylindrical pour spout 20 as illustrated in FIG. 2. Located on the inner surface of central opening 27 is at least one, but preferably a pair of annular, preferably arcuate, flanges 33 which radially project into opening 27. As shown in FIG. 1*a,* a pair of annular flanges 33*a* and 33*b* are integrally molded with the inner surface of central opening 27. A pair of flanges 33*a* and 33*b* are especially preferable for sealing fluids such as water. However, a single flange is sufficient for containers used for fluids having a higher viscosity such as fruit juice.

The radially projecting flanges 33 engage depending plug skirt 42 to form a leak tight seal for the spout 20. The attachment of skirt 42 to the periphery of disk 41 increases the structural flexibility of the plug 23 thereby forcing the plug skirt 42 to flex and inwardly deform upon engagement with radially projecting flanges 33. This deformation causes a form fit which increases the tightness of the secondary closure seal thereby resulting in a superior leak-tight arrangement when compared to other designs currently in the state of the art.

Push-pull cap 25 has a depending cylindrical body member 28 with a plurality of annularly spaced frangible elements 29 connected on its lower perimeter edge to a secondary tamper indicating band 30. The cylindrical body member 28 has a pair of vertically spaced inturned annular flanges 31 which slidably engage the outer surface of the upstanding cylindrical pour spout 20. The secondary tamper evident band 30 also has an internal annular flange 32 which is slidably engaged at the exterior of the upstanding cylindrical pour spout 20. The upstanding cylindrical pour spout 20 has two outwardly extending annular flanges 34*a* and 34*b,* respectively on the exterior thereof. The flange 32 is oppositely disposed with respect to the secondary top portion 21 and outwardly extending flange 34*a,* said outwardly extending flange 34*a* being positioned above the top 12 of the cap 10 and being oppositely disposed to and between the annular flanges 31 on the cylindrical body member 28 and the secondary tamper evident band 30, respectively.

Figure 5:
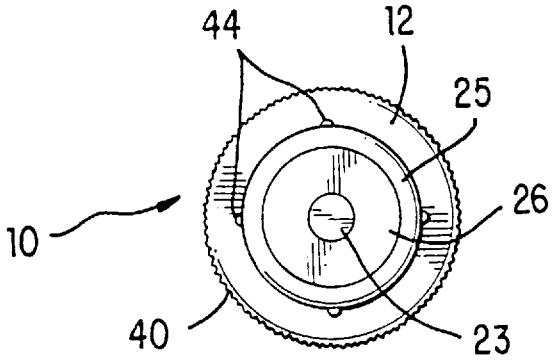
FIG. 5 is a top plan view of the resealable closure.

In assembled form as illustrated in FIGS. 1, 2, 3 and 6 of the drawings, the secondary tamper evident band 30 is joined by the frangible elements 29 to the cylindrical body member 28. The push-pull cap 25 is incapable of moving upwardly due to the interengagement of the internal annular flange 32 with the outwardly extending flange 34*a* on the cylindrical pour spout 20. Thus the cylindrical body member 28 of the push-pull cap 25 is incapable of vertical movement such as required to move the apertured top surface 26 above the plug 23 until sufficient force is applied to the push-pull cap 25 to break away the frangible elements 29 whereby the push-pull cap 25 can move to the position illustrated in FIG. 1 of the drawings wherein the opening 27 therein moves upwardly and away from the plug 23. The inturned annular flanges 31 on the cylindrical body member 28 cannot move above the outwardly extending annular flange 34*b* on the upstanding cylindrical pour spout 20 so that the push-pull cap 25 cannot be removed therefrom. As shown in FIGS. 1 and 5, a plurality of circumferentially spaced dimples 44 optionally extend from the exterior wall of the pour spout 20. Dimples 44 engage the inturned annular flanges 31 on the cylindrical body member 28 of the push-pull spout closure 25 to faciliate breaking the frangible elements 29 connecting the tamper evident band 30 to the spout closure 25. As is inherently shown in FIGS. 1, 2, 5 and 6, dimples 44 can break the frangible elements 29 by either axial or rotational movement of the spout closure 25 relative to the pour spout 7.

Referring to FIGS. 1, 2, 3 and 6 of the drawings, the tamper evident band 15 has a plurality of circumferentially spaced elevated areas 35 each of which is positioned between adjacent frangible elements 14. The elevated areas 35 extend upwardly from the tamper evident band 15 in spaced relation to the lower edge of the depending annular flange 13 of the resealable closure 10 and provide selective support of the tamper evident band 15 to resist vertical movement imparted by the deflection of the tamper evident band 15 during insertion on the bottle neck 18 thereby protecting the frangible elements 14 during assembly.

Referring to FIGS. 1, 2 and 7, depending annular flange 13 has inwardly extending spiral threads 36 depending from its interior annular surface 13A. As shown in FIG. 1, these threads 36 may be configured as a series of interrupted segments, or alternately as a continuous spiral ridge as shown in FIG. 2. Each of the threads 36 is aligned in spaced vertical relation to one another thereby defining spaced parallel thread pairs extending about at least a portion of the interior annular surface 13A and terminating adjacent the top perimeter edge of said annular depending skirt 13. Spiral threads 36 are registerable with spiral threads 37 extending outwardly from the exterior of the neck portion 18, best seen in FIG. 7 of the drawings. Referring back to FIGS. 1 and 2 of the drawings, the relative positioning of spiral threads 36 and the projections 16 on the tamper evident band 15 can be seen to be in a circumferentially spaced overlapping relationship imparting offsetting points of engagement with the respective registering counter parts of the locking annular flange 17 on the bottle neck 18.

A first annular depending sealing flange 38 extends downwardly from the closure top portion 12 in spaced relation to the depending annular skirt 13. A second sealing flange 39 extends angularly inwardly from said top portion 12 adjacent said first sealing flange 38 thereby defining a multiple sealing configuration against the neck portion 18 of the bottle during use.

Figure 6:
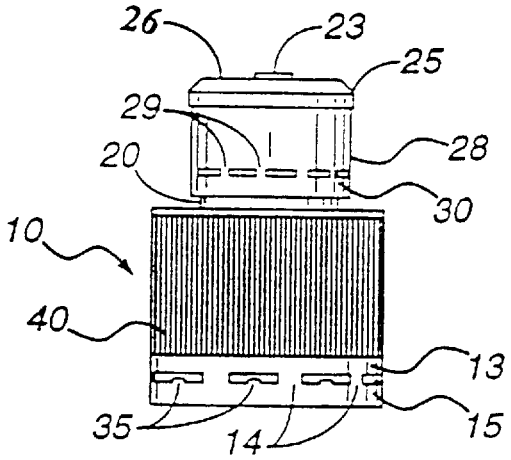
FIG. 6 is a side elevational view of the resealable closure.

Referring to FIG. 6 of the drawings, the push pull closure 10 may be seen in assembled condition as hereinbefore described in FIGS. 1 and 2 illustrating an outside rib surface 40 on the depending annular flange 13.

To remove the push pull closure cap 10 from the bottle neck 18, rotation of the cap 10 is required which will accordingly engage the respective registering spiral thread 36 and 37 moving the push pull closure 10 upwardly, breaking the frangible elements 14 connecting the tamper evident ring 15 from depending annular flange 13 thereby leaving projections 16 below the locking flange 17 on the bottle neck portion 18 as will be well understood by those skilled in the art.

While presently preferred embodiments of the invention have been shown and described in particularity, the invention may be otherwise embodied within the scope of the appended claims.

What is claimed is:

1. In a push-pull pour spout for use with a resealable closure, said pour spout comprising a spout member defining a spout opening and having positioned in spaced relationship thereto a plug with at least one support member defining said relationship and a slidable secondary closure member for cooperation with said plug the improvement therein comprising:

(a). said plug comprising a circular disk and an integral depending annular skirt extending from the periphery of said disk to attach said disk to said support member thereby defining a hollow cavity within said plug;

(b). said secondary closure member having a central opening therethrough, wherein said central opening has a diameter substantially the same as that of said plug, said opening being defined by an inner surface having at least one annular seal flange projecting radially into said opening for engagement with said plug; and (c). a plurality of circumferentially spaced dimples extending from said spout member.

2. The improvement set forth in claim 1, further comprising an annular wall depending from said secondary closure member having at least one inwardly extending annular first flange spaced a distance from said secondary closure member greater than the length of the inner surface of said opening to permit said secondary closure member to slide and disengage said plug to permit a fluid to pass through said central opening.

3. The improvement set forth in claim 2, wherein said first flange engages an external flange on said spout to inhibit removal of said secondary closure member.

4. The improvement set forth in claim 1, further comprising a tamper evident band attached to the end of said closure opposite said pour spout and having at least one locking member extending radially inward from said band at an angle to a plane normal with said band.

5. The improvement set forth in claim 4 wherein said locking member comprises a flange having a groove.

6. The improvement set forth in claim 5 wherein said locking member is continuous.

7. The improvement set forth in claim 5 wherein said locking member is discontinuous.

8. The improvement set forth in claim 4 wherein said locking member is continuous.

9. The improvement set forth in claim 4 wherein said locking member is discontinuous.

10. The improvement set forth in claim 1, wherein said secondary closure member has two annular seal flanges.

11. The improvement set forth in claim 1, wherein said at least one seal flange is continuous.

12. The improvement set forth in claim 1, wherein said at least one seal flange is discontinuous.

13. The improvement set forth in claim 1, wherein said dimples are spaced equally around the circumference of said spout member.

* * * * *